US007041980B2

(12) United States Patent
Schuller et al.

(10) Patent No.: US 7,041,980 B2
(45) Date of Patent: May 9, 2006

(54) EXCHANGEABLE COMPONENT OF A TEXTILE MACHINE WITH A SURFACE COATING OR SURFACE TREATMENT AND A MEANS FOR THE DETECTION THEREOF

(75) Inventors: Edmund Schuller, Ingolstadt (DE); Werner Strasser, Steckborn (CH)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 256 days.

(21) Appl. No.: 10/464,800

(22) Filed: Jun. 18, 2003

(65) Prior Publication Data

US 2004/0113090 A1 Jun. 17, 2004

(30) Foreign Application Priority Data

Jun. 24, 2002 (DE) ..... 102 28 208

(51) Int. Cl.
*G01N 3/56* (2006.01)

(52) U.S. Cl. ..... 250/361 R; 250/458.1

(58) Field of Classification Search ..... 250/361 R, 250/458.1, 461.1; 356/317, 318, 417; 57/404, 57/104

See application file for complete search history.

(56) References Cited

U.S. PATENT DOCUMENTS 5,390,868 A 2/1995 Kiriake
5,509,262 A 4/1996 Stahlecker
5,560,775 A 10/1996 Conboy et al.
5,765,358 A 6/1998 Bock et al.
5,855,110 A 1/1999 Bock et al.
6,006,512 A 12/1999 Schmid
6,009,700 A 1/2000 Wassenhoven et al.
6,195,976 B1 3/2001 Wassenhoven et al.
6,205,761 B1 3/2001 Wassenhoven et al.
6,220,761 B1 * 4/2001 Bock et al. ..... 384/549
6,321,522 B1 11/2001 Landolt et al.
6,552,787 B1 * 4/2003 Potyrailo et al. ..... 356/317
2002/0140306 A1 * 10/2002 Schuller et al. ..... 310/91
2003/0070414 A1 4/2003 Pohn et al.

FOREIGN PATENT DOCUMENTS

DE 19909871 10/2000
DE 19909871 A1 10/2000
DE 10002253 A1 8/2001

OTHER PUBLICATIONS

German Search Report, Sep. 30, 2002.
EPO Search Report, Jul. 16, 2004.

* cited by examiner

*Primary Examiner*—Otilia Gabor
(74) *Attorney, Agent, or Firm*—Dority & Manning

(57) ABSTRACT

An exchangeable component of a textile machine with a surface coating or a treated surface within which color elements are embedded is provided. The color elements in the surrounding area of the coating or the treatment, upon radiation by a light of a first wave length or of a first spectral range of wave lengths, emit a light of a second predetermined wave length or a second predetermined spectral range of wave lengths. Furthermore, a detection apparatus is provided with a source of illumination for the radiation of such a component and for the detection of the emitted light.

49 Claims, 6 Drawing Sheets

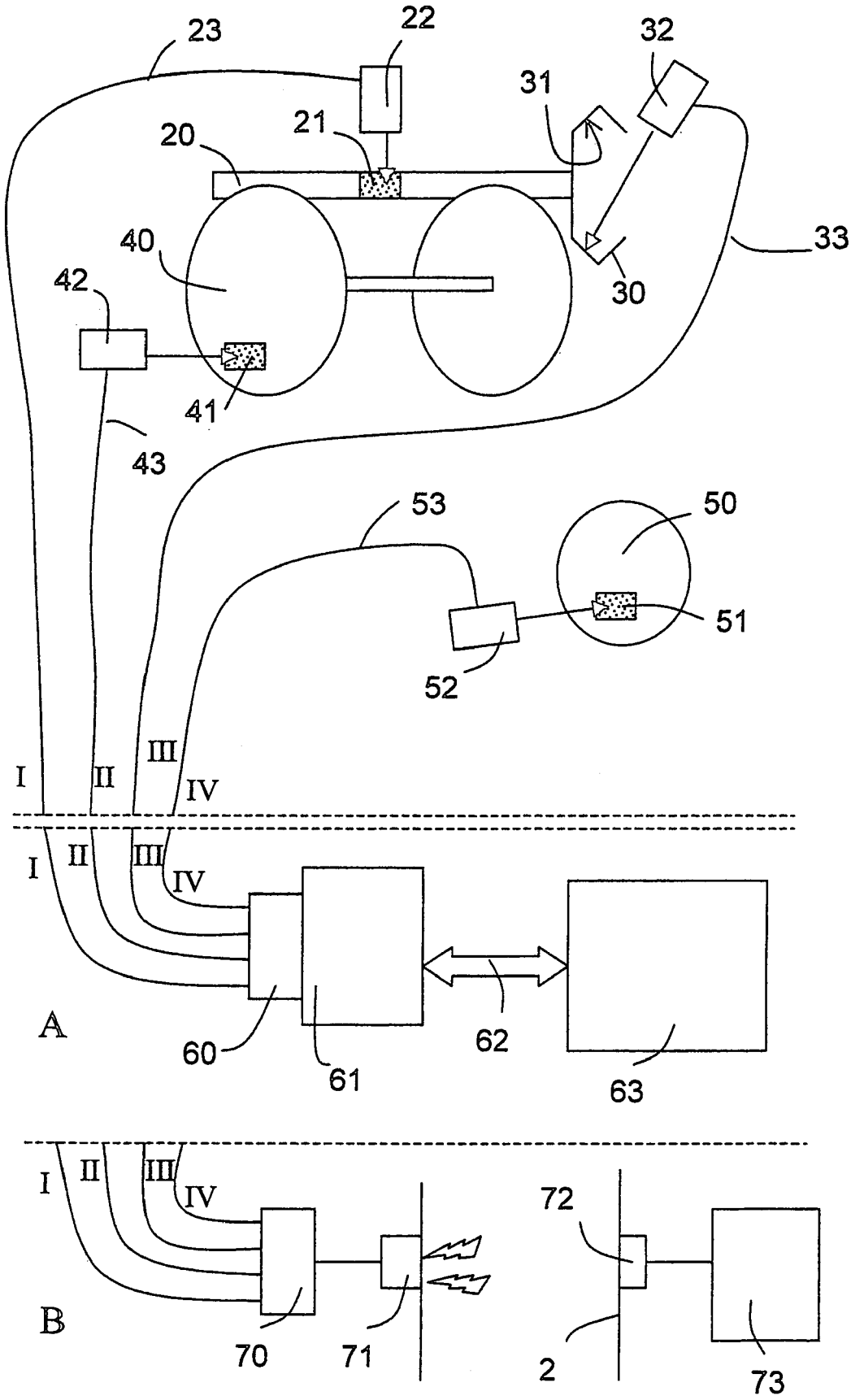
23
22
32
31
21
20
33
40
30
42
41
43
53
50
51
52
I
II
III
IV
I
II
III
IV
A
60
61
62
63
I
II
III
IV
B
70
71
72
2
73

EXCHANGEABLE COMPONENT OF A TEXTILE MACHINE WITH A SURFACE COATING OR SURFACE TREATMENT AND A MEANS FOR THE DETECTION THEREOF

FIELD OF THE INVENTION

The invention concerns an exchangeable component of a textile machine with a surface coating or surface treatment and an optical marking as well as an apparatus for detecting the marking.

BACKGROUND OF THE INVENTION

EP 0 922 797 A2 discloses a spin rotor for an open-end spinning machine, wherein, on the circumference thereof, an identification designation is placed. The identification marking is read, without physical touching, by a sensor, which is installed on an attendant service unit. The signal which contains an identification designation to be read off by the service unit, is compared with data in a control device. If the signal does not comply with a predetermined set of designation data, then the service unit is commanded to withhold a resumption of spinning on the concerned open-end spinning machine. In this way, assurance is provided that, for instance, only spin rotors which are without question technically appropriate can be brought into service. The proposed identification marking can be a bar code or a transponder. The sensor detects and reads the identification marking inductively or optically. The application of the identification marking is complex and requires a separate work step in the manufacture of a spin rotor.

EP 1 035 241 A1 makes known a spin rotor, wherein, on the circumference of the rotor plate, a designation is placed, which, upon stillstand of the spinning rotor, can be read visually by a service operator. In this way, however, no automatic control of the type of spin rotor can be realized.

OBJECTS AND SUMMARY OF THE INVENTION

Thus, it is a principal purpose of this invention to provide an exchangeable component of a textile machine, especially a spin rotor, with a surface coating or surface treatment having an optical marking, wherein the marking can be economically placed and easily read visibly or by machine and to provide further, a sensing device for the reliable detection of such a component. Additional objects and advantages of the invention will be set forth in part in the following description or may be obvious from the description or may be learned through practice of the invention.

In accord with the invention, an exchangeable component of a textile machine is provided with a surface coating or a surface treatment, in which specially selected coloring elements are implanted. Upon the radiation of the coloring elements with light, the coloring elements emit or their immediate contiguous neighborhood emits, light of an individually select, specified wavelength or light of a specified spectral range of light. On the basis of the emission of this second wavelength, or the spectral range, the component itself can be identified and/or the presence of the surface coating, that is the surface treatment of the component, can be affirmed. With the intended implantation of coloring elements, a desired light emission is reproducibly generated, so that extraneous, problematic effects are excluded or repressed.

A surface coating in this respect is any covering layer, which can be deposited on the component during manufacture, for example, for the purpose of bringing about a special conditioning of the surface, for instance, in regard to roughness, friction characteristics, or an improvement in operational life by the increase of the resistance to abrasion. In the case of the surface treatment, during manufacture, the surface of the incipient component is modified in that area which is to receive the coating. For example, the modification may include the implantation of elements or a phase transposition in that area approaching the surface. Obviously, a coating can be deposited, or the coating itself executes a modification of the near surface zone of the concerned component.

It is desirable to have the coating or the surface treatment provided in an area of the component, which is subjected to severe attrition and/or contamination, in order that such attrition and/or contamination of the component may be detected.

If a type of an exchangeable component is provided with these color elements implanted in its coating or its surface treatment, then the possibility arises, that this component is now adapted for special qualitative demands. For example, highly stressed spin rotors are individually provided with a first color mark, namely a red emission, showing that these spin rotors are suitable for rotational speeds up to 120,000 revolutions per minute. Other types, which, for instance, my be only capable for 100,000 revolutions per minute, can be provided with color elements, which emit only yellow, as a second color marking. Further, a spin rotor, capable of only 80,000 revolutions per minute, can be provided with coating or surface treatment carrying color elements emitting green, as a third color marking. A corresponding chromatically staged emission of the wavelengths can, of course, be provided for all other exchangeable components of a textile machine, if specific types are available for different application purposes. In this way, the usage of the reliable operation parameter-ranges are designated by various known color emissions.

In accordance with the respective embedment of the color elements in the coating or surface treatment, and dependent upon the color elements themselves, the emitted light is generated by reflection, luminescence, phosphorescence or a combination thereof. Advantageously, luminescence or phosphorescence effects are employed, whereby a wavelength displacement between inciting light and emitted light is made available.

Especially advantageous is a situation wherein the inciting, first wavelength or the first spectral range of wavelengths, and the emitted second wavelength or the second spectral range of wavelengths are different. Thereby, the avoidance is brought about that, upon the capture of the emitted light, principally the inciting wave length is brought to the sensor by multiple reflection or dispersion, and thus, false conclusions might be drawn in regard to the presence of the color elements in the coating or surface treatment. As a rule, what occurs is a displacement of the wavelength by means of the color elements from a shorter, inciting wavelength to a lower, emitted wave length or wave length range. Advantageously, the incitation is caused by ultra violet light and the emitted wave length or the wave length range lies in the visible part of the spectrum, so that a user of the component can make an identification by observation during radiation with the ultra violet light. Conversely, if the emitted wave length, that is to say, the wave length range, is that of infrared light, then there occurs, first, a greater choice of potential color elements, and second, there becomes available sources of favorable cost for the excitation of the coloring elements. For example, luminescent diodes, which emit in the visible or infrared spectral ranges.

Coating or surface treatment proves especially advantageous, particularly when it is of an abrasion resistance nature, so that, by means of the emission of the second wave length or the second spectral range of wavelengths, the determination can be made as to whether or not, during the operational life of the component, the coating is present in sufficient thickness of the required areas. In the case of a friction sensitive layer or surface treatment, for example, molybdenum disulfide, Teflon®, or graphite particles can be embedded.

In each case of necessary coating or surface treatment, allowing for dependence upon incitation or emission wave length and the technical possibilities for the determination of the coloring element in defined positions or installation locations of the involved component, a choice exists in regard to different kinds of coloring elements or types of implantation of the coloring elements in the coating or surface treatment. In the case of a homogenous coating or surface treatment (without the implantation of particles), the coloring elements can be embedded as chemical elements or molecules or as particles (for instance, "nanocrystallite"). Where implantation is concerned, which consist of a mixture of a matrix and embedded particles of the same, the coloring elements can be employed as chemical substances in the matrix or the implanted particles can be bundled therein or even be particles which are incorporated in the matrix. Finally, before the actual coating operation, a surface treatment can be made of the coloring elements, so that these emit, as long as the thereover layered coating is present. In the latter case, for example, the intensity of the emitted light increases as the outer covering decreases, until finally even the emission ceases, when the layer with the coloring elements is worn away.

If the coloring elements themselves are specially implanted particles in the nanometer or the micrometer range, then a reproducible wavelength of the emission is achieved, since the emission itself is not further influenced by the ambient environment, for instance, by the matrix. Correspondingly, if the coloring elements can be implanted as invading imperfections in the particles of the original coating, for example in the diamond or ceramic particulate. For instance, ruby particles, in which alumina particles with chromium or chromium oxide, namely $Cr_2O_3$, is implanted, will then illuminate in the known ruby red color. Furthermore, laser-active solid materials are known, wherein, upon incitation with a flash-light, these emit at an optional laser wavelength. For instance, if yttrium-aluminum-garnet (YAG) is dosed with certain elements, such as (neodymium (Nd—1.064 μm), erbium (Er—2.94 μm) or Holmium (Ho—2.1 μm), then each emits in accord with the respective element at different wave lengths. Even porous semi-conductors (Si, SiC) fluoresce by excitation with ultraviolet light until they are down into the nanocrystalline state.

The marking of the components can be carried out very simply, if the coloring elements are printed upon the given component.

The coloring elements can be invisible to the human eye, if appropriate apparatuses are employed.

A particularly positive determination of the coloring element of a coating or surface treatment of an exchangeable component is done with a detection apparatus. By means of an illumination apparatus, the light of a first specified wave length or a spectral range of wave lengths is radiated and the light emitted from the component is captured by a light receiving apparatus, especially in the case of a second predetermined wavelength or a second predetermined spectral range of wavelengths. Therewith, the incitation of the coating or surface treatment, is effected and the determination of the captured wave lengths is carried out in a defined, orderly manner, so that any disturbance effects, such as stray light can be predominately excluded.

Advantageously, the illumination apparatus encompasses a light diode or a laser diode, which emit within a narrow banded wavelength range. In the case of the laser diode, additionally a directed light beam can be obtained, so that the alignment is simplified to be upon the given coating or surface treatment. If additionally, light fiber conductors are employed, then the light fiber can be precisely directed onto locations which would normally be inaccessible. With a color or a band-edge filter in the path of the light capture device, stray light can be repressed and an implant on the desired, determined second wavelength or the second spectral range of wavelengths can be achieved.

If a detection apparatus is to be installed on a rotor spinning machine, this apparatus could well exhibit a data memory capability with which the presence or the absence of the detection signal therein could be registered. This capability would allow recognition as to when an abrasion-resistance coating is worn away, or that, in a case of quality problems, the cause could be related to a non-appropriate component. Advantageously, the detection apparatus can be employed as part of the maintenance/service device, since principally, such an apparatus is necessary for the monitoring of the components at each individual workstation.

It is also advantageous if the detection apparatus, especially during the usage of fiber light conducting means in the sensor head, is installed in an extension arm of the maintenance/service device for a respective workstation, or indeed, installed on the component to be monitored. Upon the detection of a spin-rotor as an exchangeable component, advantageously, the detection apparatus or the corresponding detection head is provided on the extension arm with a cleaning module, which permits one extension arm to serve for both operations.

For the monitoring of the added equipment on a spinning station, with at least one exchangeable component, a display and/or an interrogation system should be provided. Such an arrangement generally includes an LCD-display with one or more lines, or a display screen, which is equipped to respond to queries and has corresponding input keys or is provided with a computer keyboard. On this account, it is possible for the operating person to call up the actual configuration directly at the individual spinning station and to monitor in this manner. With such equipment, the display or the interrogation can be on a need-basis, either at each spinning station, or central on the spinning machine, or as part of a distributed control system for the spinning machine. It may again be at a maintenance apparatus, at a central control station for the spinning plant, or located externally in a central service station.

Advantageously, the interrogation capability permits calling up the configuration of each spinning station of the spinning machine. The data thereby collected by this query-capability can be correlated with other data obtained from the spinning station. For example, the measured state of quality of the produced thread is correlated with the accessory equipment of the station, or the full operational life of an exchangeable component can be supervised, thus allowing a statistical quality control system to be carried out, based on the acquired data. If, for example, the thread quality lies too often outside of a tolerance limit, then, first, it can be determined whether the configuration of the exchangeable components at the spinning station are appropriate for the desired quality level, or, second, the expert can rely on other, empirical data which demonstrates a causal relation between the basic quality of the thread and a specific, existing spinning machine component.

In the case of a control system, the determined and evaluated data from the spinning station is employed, in order to optimize control parameters for the entire spinning machine and, of course, to optimize the control of the specific spinning station. Accordingly, optimized parameters at the spinning machine or spinning station can then be activated. In the presence of the achieved results from the quality control, active measures are obtained, which contribute to the continued increase of the quality of the spun thread.

The display or the interrogation apparatus and the control system are not only applicable to the spinning station of a spinning machine, but contribute to the detection, monitoring and control of other spinning related machines in a spinning works. Examples for such spinning related machines with at least one exchangeable component, could be machines for carding or drawing, or also a ring spinning machine.

Embodiments of the invention are provided below in greater detail with the aid of the drawings.

BRIEF DESCRIPTION OF THE DRAWINGS

FIG. 5 shows a schematic arrangement for the detection of the color markings on exchangeable components.

DETAILED DESCRIPTION

Figure 1A:
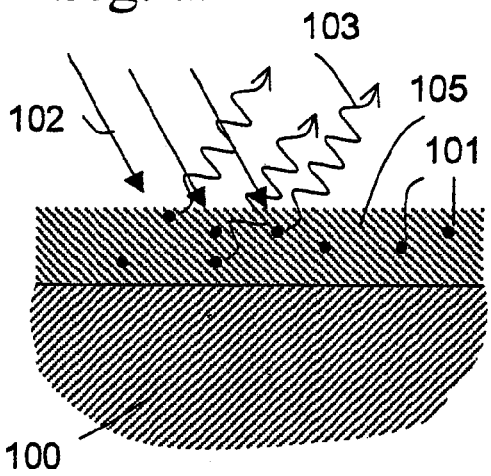
FIGS. 1A to 1E show various embodiments of the implantation of coloring elements in layered coatings.
Figure 1B:
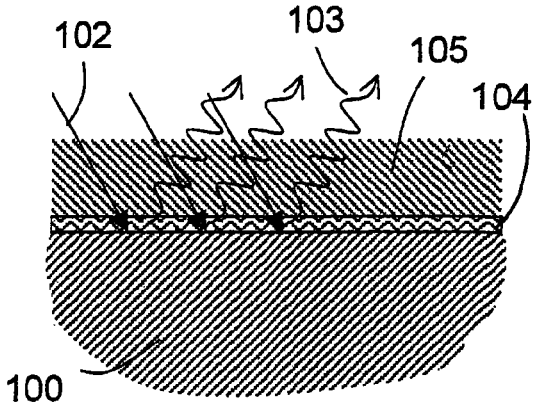

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

The FIGS. 1A–1E show partial cross sections through the coating layers on the basic bodies 100 of an exchangeable component. In the case of the embodiment of the FIG. 1A, the basic body substrate 100 is overlaid with a hard resistant coating 105. Coloring elements 101 can be embedded in a desired area of the resistant base coating. The coloring elements are either chemical elements or molecules which tend to the emission of a certain light wavelength. In this way, the coloring elements can serve as interference points, so that the immediately surrounding hard coating areas emit light, or the coloring elements themselves can be the light emitters when incited by radiation with incident light. The radiation with light is, for example, presented in the figures by the straight, arrows and is designated as incitation, or inciting, light 102. The emission subsequent to the incitation is shown as wavy arrows and called the emitted light 103.

In the case of the embodiment of 1B, in the coating process, first an illumination layer is deposited, namely layer 104. Upon this layer, the hard, resistant coating 105 is applied. The illumination layer 104 contains the coloring elements and emits light when excited by the incitation light 102. Advantageously, this illumination layer 104 takes over additional functions, such as, for instance, as a holding primer between the basic body 100 and the hard material layer 105. If the hard material layer 105 is not transparent, or not sufficiently transparent for the incitation light 102, or for the emitted light 103, then the emission light 103 can then only be detected if the hard layer 105 is sufficiently thin or is already abraded to a thin condition. As a result, by the determination of the emitted light 103, a conclusion can be made, that the hard material layer 105 is in a worn condition.

Figure 1C:
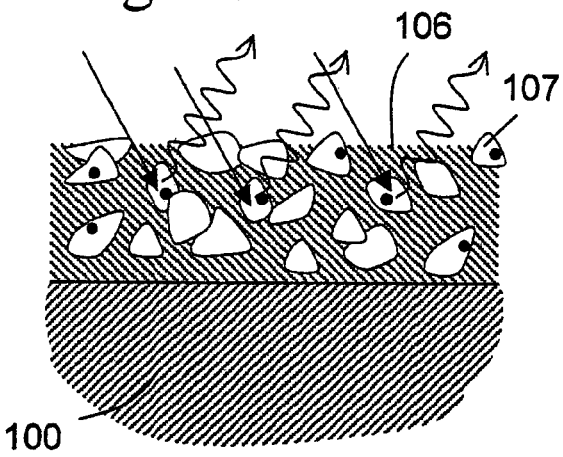
Figure 1D:
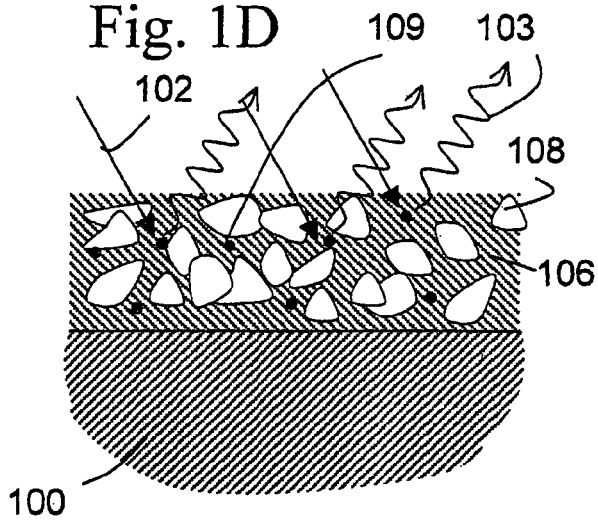
Figure 1E:
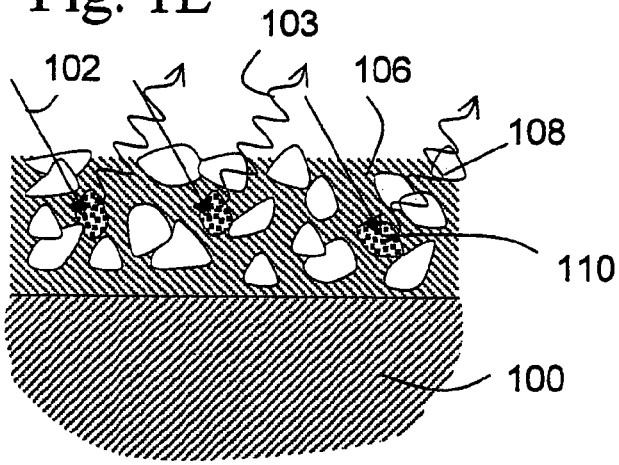

FIG. 1C shows an embodiment, wherein the applied coating consists of a combination of a matrix layer 106 and hard material particles 107 inlaid therein. The hard material particles 107 contain coloring materials, so that, upon excitation of the hard material particles, light of the desired wavelength is emitted, or, so to say, is broadcast. Again, the coloring elements can serve as interference points built into the hard material particles 107. The hard material particles (105, 107, 108) and/or color particles (110) may be diamond and/or ceramic (YAG, $Al_2O_3$, SiC, $Si_3N_4$). As a result, these particles illuminate, or the coloring elements illuminate within the hard material particles 107. In the first case, there will be found the implantation of chromium or chromium oxide in $Al_2O_3$ (sapphire), so that a known ruby red is to be observed. Also, the ceramic particles such as YAG can be dosed with rare elements. FIG. 1D is a variant of FIG. 1C, wherein the hard material particles 108 do not themselves emit. In place of these, a matrix 106, which contains the embedded coloring elements 109, does itself emit light in response to the incitation, as this was described in FIG. 1A. Further, the matrix (106) can contain nickel, or nickel and phosphorous.

Where the embodiment of FIG. 1E is concerned, in the matrix 106 of the coating, non-emitting hard material particles 108, and thereto accompanying emitting particles 110 are incorporated. These emitting illumination particles 110 are, for example, chromium, or chromium oxide dosed $Al_2O_3$-particles or porous silicon or another porous ceramic, all of which fluoresce when excited by ultraviolet light. In the case of varying the embodiments shown in 1A–1E, various responsive illuminating coloring elements 101, 109 or coloring elements of differing constituents, namely 104, 105, 106, 107, 108, 110, or yet of varying shapes can be embedded, which allows at least two emission wavelengths to be available. Thereby, such a coating makes possible a color-coding, so that, for example, besides the recognition of the component or the wear thereon, in addition the designation of the construction characteristics thereof can be seen. Instead of, or in addition to, the hard material particles, it is possible that friction resistant particles can be furnished for embedment in the matrix, such as Teflon, graphite or molybdenum disulfide.

Figure 2A:
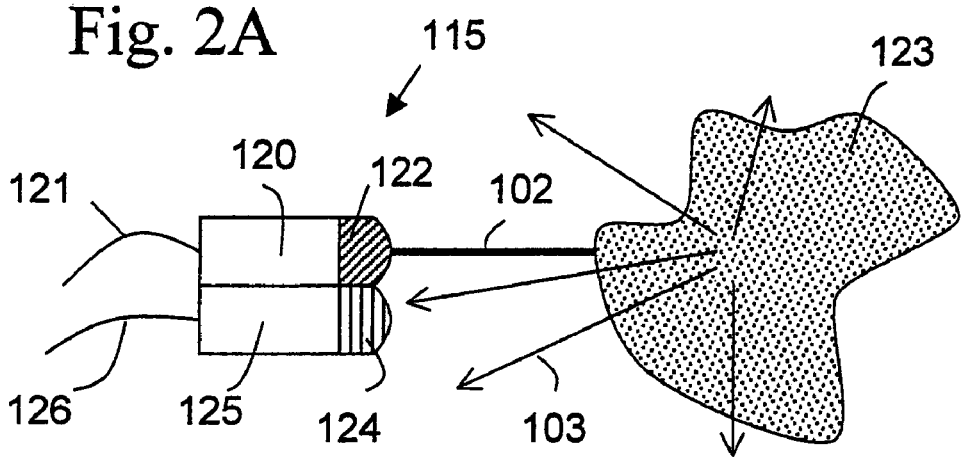
FIGS. 2A and 2B show two embodiments of sensor units for the incitation and detection of emission.
Figure 2B:
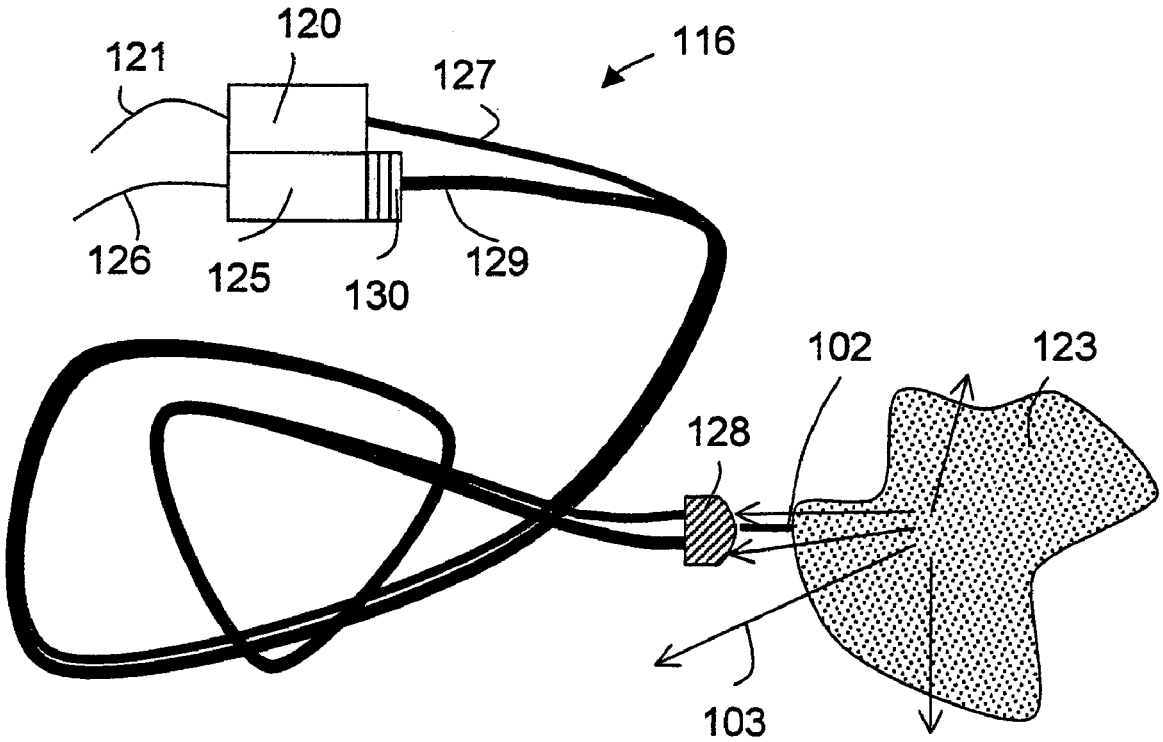

The FIGS. 2A and 2B show schematically, two embodiments of sensors 115, 116. The sensor 115 of FIG. 2A is provided for direct application onto the surface 123 which is to be examined, while the sensor 116 of FIG. 2B is subdivided into a base unit and a measuring head, connected by fiber light transmitting cables 127, 129 to the base unit. In the case of the sensor 115 (FIG. 2A), the inciting light 102 is produced by a laser/light diode 120. The light is focused through a lens 122 and directed onto the surface 123. The emitted light 103 falls, in part, on an optical system 124 which is electrically coupled to a photodiode 125 for the detection of the emitted light. The optical system 124 encompasses a combination of lenses and color filters, so that, first, only that point is captured which is illuminated by the inciting light 102, and, second, by means of the color filter, the emission wave length of the emitted light 103 is selectively detected. The diode laser 120 is supplied by a line 121 and the photodiode 125 sends the signal over a line 126 to a subsequently connected evaluation circuit. Furthermore, the line 126 provides a current supply for the photodiode 125, so that the photodiode 125 can detect the emitted light 103 with even greater sensitivity.

Figure 3:
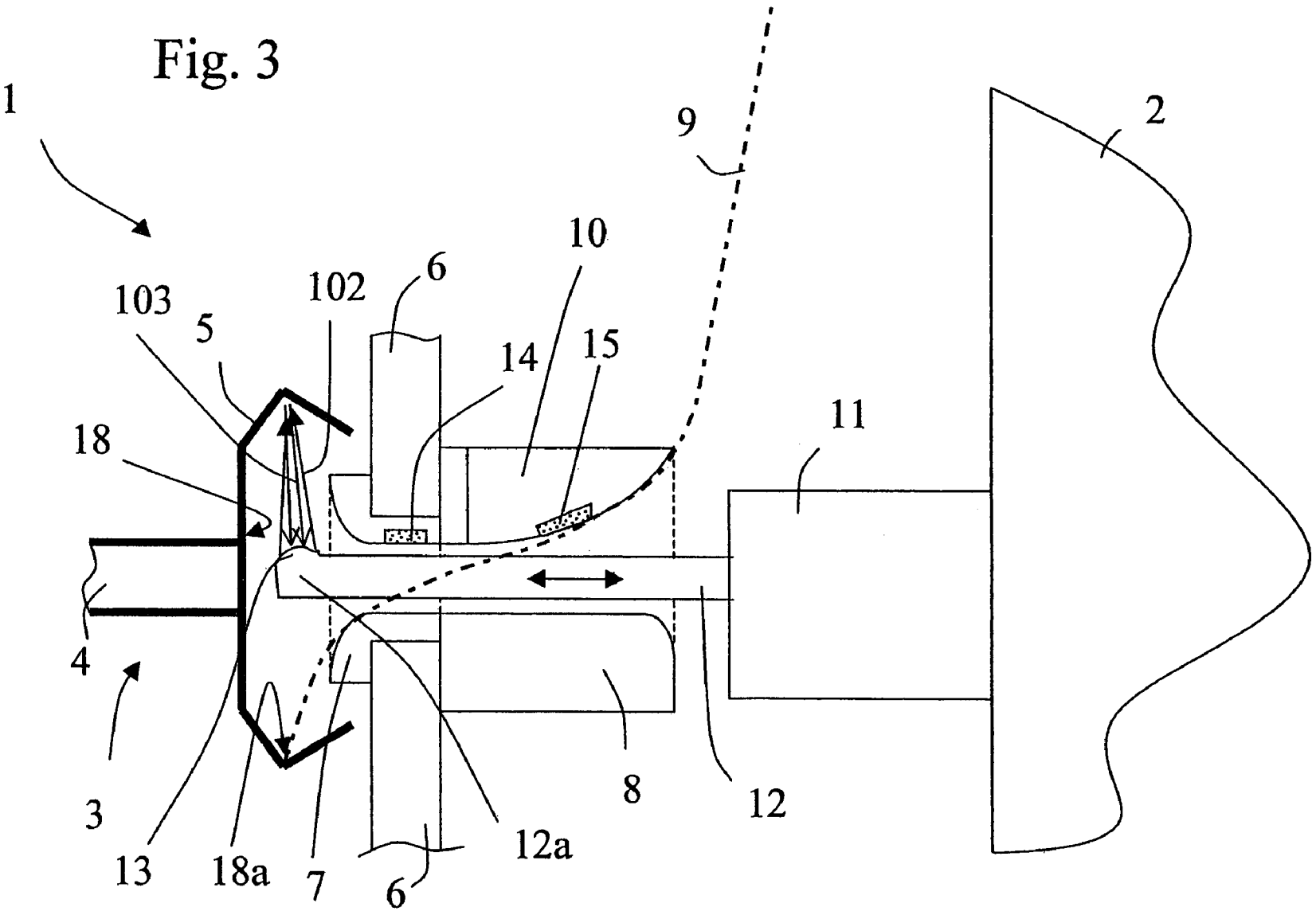
FIG. 3 shows a partial cross-section of a spinning station and a robot installed in the spinning station with an endoscopic sensor apparatus.

FIG. 3 demonstrates a partial cross-section of a spinning station 1 of a rotor spinning machine and a partial profile view of a robot 2 which services the spinning station 1. In the spin-box of the spinning station 1 in known manner, a spin-rotor 3 is rotatable bearing supported and driven. On the forward end of a shaft 4 of the spinning rotor 3 is affixed a rotor bowl 5. Situated opposite to the open side of the rotor bowl 5 is placed a thread removal nozzle 7, set within a covering 6 of the spin-box. On the outer side of the covering 6 there is joined to the thread removal nozzle 7 a small diameter thread removal tube 8.

During the thread production, a spun yarn 9 is pulled out of the lateral groove 18*a* of the rotor bowl 5 through the existing thread removal nozzle 7 and the thread removal tube 8. The course of the yarn 9 in this operation is shown in FIG. 3 by a dotted line. The spinning start of the yarn 9 is carried out in a normal manner by means of the robot 2 and the yarn 9, when the start is complete, is transported through a removal roll pair (not shown) and in a known manner is wound upon a running, driven spool.

In the small diameter, thread removal tube 8 is inserted on the top side, a disk-like twist-repressor 10, which is as free as possible from abrasive action on the running removal of the yarn and possesses a surface structuring to permit a desired number of rotations per yarn length. The passage of the thread removal tube 8 is designed to be similar to a slot, whereby the entrance slot spatially borders on thread removal nozzle 7 and corresponds to the cross section of the boring in the thread removal nozzle 7, and on the thread exit side, opens upward in a funnel-like manner. The free cross-section of the boring of the thread removal nozzle 7, on this account, is coaxially extended by the contiguous thread removal tube 8 which later then widens itself upward, as shown on FIG. 3. Upon the withdrawal of the yarn 9, the yarn 9 lies on a bowed segment of the twist repressor 10.

On the robot 2 is to be found a movably installed detector 11, which, upon demand, can be extended into a position oppositely situated to the thread removal tube 8. In the detector 11 is bearingly supported an extendable detector tube 12 with a sensor head 12*a*, which can be run out of the housing of the detector 11 for the capture of markings.

When the said detector tube 12 is so extended, it proceeds through the thread removal tube 8 and the thread removal nozzle 7 until it is in the neighborhood of the rotor bowl base 18.

In this detector tube 12, run light-conducting fibers, which are conducted to the sensor head 12*a* of the tube 12 and are there electrically bound with imaging system 13. In the detector 11 is placed a source of illumination, the light of which is conducted through the light-fibers in the tube 12, and from there exits the image system through, for example, a lens. The emitted light 103 from the object to be examined is once again collected by the imaging system 13 and coupled back into the detector 11 through the light fibers, at which point the emitted light is captured by an opto-electronic sensor. If the object to be examined contains a color marking, then the detector 11, considering the dependence on the lighting source, on the stray light, and giving consideration to the spectral range emitted by the object, also incorporates a frequency band filter and a spectral resolution element, for example, as has been discussed above in relation to FIGS. 2A and 2B.

On the inner surface of the twist repressor 10, is placed an optical marking 15 in the form of a surface treatment, or a coating with color elements (see FIGS. 1A–1E). This is only symbolically indicated in FIG. 3. This optical marking 15 is detected by the imaging system 13 as it moves into position through the thread removal tube 8. Corresponding to the marking 15, an optical marking 14 is placed on the inside of the boring of the thread removal nozzle 7, which is detected upon the passage of the tube 12 and imaging system 13 into the spin-box. As soon as the detector tube 12 is in its fully extended position, an optical marking in the form of a coating or a surface treatment (see FIGS. 1A–1E) is detected especially in the rotor groove 18*a*. The imaging system 13 focuses the inciting light 102, directing it into the rotor groove 18*a* and thus detects the emitted light 103 which emanates locally therefrom.

Figure 4B:
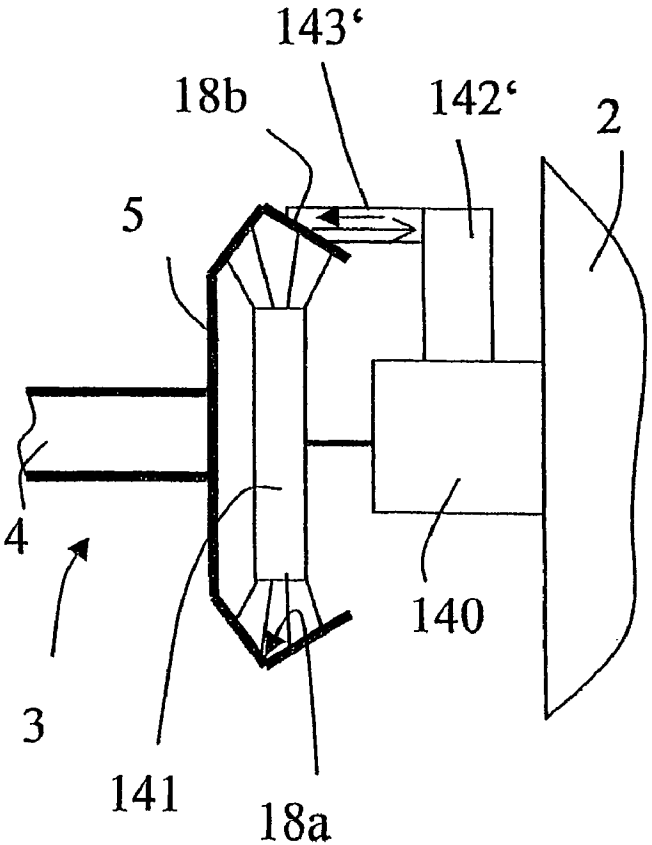
FIGS. 4A and 4B show two embodiments of the detection means for color markings on a spin rotor.
Figure 4A:
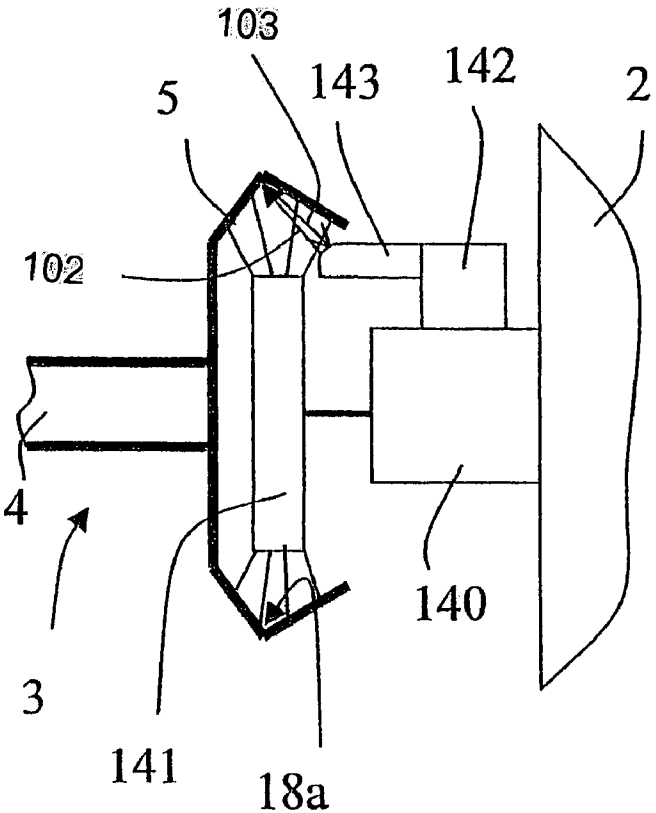

FIGS. 4A and 4B show two embodiments of arrangements for the detection of optical markings in the form of a coating carrying therewith color elements in or on a spin-rotor bowl 5. Similar to the FIG. 3, the robot 2 is available to the spinning station for maintenance. In this case, the rotor cover of the spinning station is swung away, and an extendable unit 140 adjustably moves a cleaning head 141 into the rotor bowl 5. The cleaning head 141 is motor driven for the cleaning of the rotor interior. On the extendable unit 140 is placed a sensor device 142 with an optical head 143. The head-end of the optical head 143 is located adjacent to cleaning brushes of the cleaning head 141 and has an optical element for the focusing of the inciting light in the direction of the rotor groove 18*a*. The emitted light 103 is likewise, in a focused manner, received from the rotor groove 18*a* to be evaluated in the sensor 142. The brushes on the cleaning head 141 are not equally distributed on the circumference thereof, but between the bristles, are to be found separating openings, so that in the circumferential direction, vacancies are evident, through which the inciting light 102 from the optical head 143 can be sent to the rotor groove 18*a* and conversely the emitting light 103 can be received therefrom.

Besides the detection of the abrasive wear or the identification of the rotor 3, it is possible, that simultaneously therewith, the results of the cleaning of rotor groove 18*a* can be examined. The failure of an emission signal gives indication thereof, that either the rotor with the special rotor groove coating is not in place, the wear resistance layer in the rotor groove is worn through, or contaminations still exist in the rotor groove. The latter can be verified, in that the cleaning cycle with the cleaning head 141 can be prolonged, in order that the desired degree of cleaning can be achieved. Should the emitted light still not be detected after a lengthy cleaning period, then, first, there is probably a solidly set contamination deposit in place, so that the rotor 3 must be subjected to maintenance service. Second, the protective wear layer may be exhausted, which likewise calls for maintenance services. Another possibility is that the component is actually not provided with the appropriate special coating code. For example, in the latter case, the rotor speed of rotation is reduced in cases where special rotors are required for extremely high speeds of rotor rotation, or the spinning station, due to security measures, would not resume spinning.

FIG. 4B shows the arrangement of 4A with a modified sensor 142' and a modified optical head 143'. In this case, the optical head 143' detects an optical marking in the form of a coating or surface treatment on the outer circumference of the rotor bowl 5 in the wall zone 18*b*. Situated opposite from the wall 18*b*, an optical window on the optical head 143' is provided, through which the wall 18*b* can be illuminated. The window serves conversely to admit the emitted light back into the optical head 143'. Advantageously, the sensor 142' and the head 143' are designed to be mechanically strong, so that beside the optical capture as well as by means of the positioning of the optical head 143' on the outer wall, a rotation of the rotor 4 during the cleaning operation with the cleaning head 141 is prevented.

FIG. 5 presents an opto-electronic detection system for the optical capture of exchangeable components at a spinning station of a rotor spinning machine. For a clearer overview of the assembly of the system, the individual elements are only reproduced in schematic form. Arrangement and operation of the elements of the rotor spinning machine are carried out in a conventional manner. Where FIG. 5 is concerned, 20 designates a shaft of the spin-rotor, 21 denotes an optical marking on the shaft 20, 22 denotes an optical sensor head and 23 designates a signal line. Further, 30 represents a rotor bowl, 31 denotes an optical marking on the rotor bowl 30, 32 indicates an optical sensor head for the reading of the marking 31 and 33 denotes a signal line. 40 stands for a support disk for carrying the rotor shaft 20, 41 represents an optical marking on the support disk 40, while 42 denotes an optical sensor head and 43 a signal line. 50 shows a side part of a disintegrating roll, 51 shows an optical marking on the side part of said disintegrating roll 50, while 52 represents an optical sensor head and 53 denotes a signal line thereto connected. All, or at least a part, of the markings 21, 31, 41, 51 are coatings (see FIGS. 1A–1E) or they can be also treated surfaces with specially embedded color elements to allow the achievement of a desired, reproducible emission wave length, i.e. a spectral band. For example, the marking 21 is a hard, wear resistant layer on the rotor shaft in the equipment area of a driving, tangential belt (not shown) or it may be found in the equipment area of the support disk 40.

The sensor heads 22, 32, 42, 52 as well as the signal lines 23, 33, 43, 53 are identically designed. The sensor heads can be in some cases passive receivers for the radiation and reception of light, which, in this case is transmitted through light conducting fibers as signal connections (as, for example in FIG. 2B). On the other hand, the sensor heads can be active, opto-electronic components, which illuminate the markings themselves, pick up the reflected light and convert this light into electrical signals (as is shown in FIG. 2A). In this case, the signal lines would be electrical lines for the transmission of the measured signals from the sensor heads and also to assure the availability of the source of voltage for the sensor heads.

A first embodiment example of the handling of signals is shown in FIG. 5 with an "A". In this case, the signal lines 23, 33, 43, 53 are combined in an opto-electronic or electronic multiplexer 60 and from this, a signal is forwarded to a reception and evaluation unit 61. From that unit 61, evaluated signals are dispatched through a data channel 62 to a control unit 63 of the spinning station or to a control unit of the rotor spinning machine. The unit 61 can be integrated in a section controlling device, so that data, respectively, of a group of spinning stations can be detected sectionwise or individually.

In a second embodiment example, ("B" in FIG. 5) the signal lines 23, 33, 43, 53 are run together in an opto-electronic or an electronic multiplexer 70, and sequentially transmitted over a line to a sender 71. The sender 71 transmits the multiplexed signal on an optical pathway to the robot 2, which is an accessory to the spinning station 1. The robot 2 has a receiver 72 for the acceptance of the optical signal from the sender 71 and transmits the received signal to the control unit 73 of the robot 2.

Figure 6:
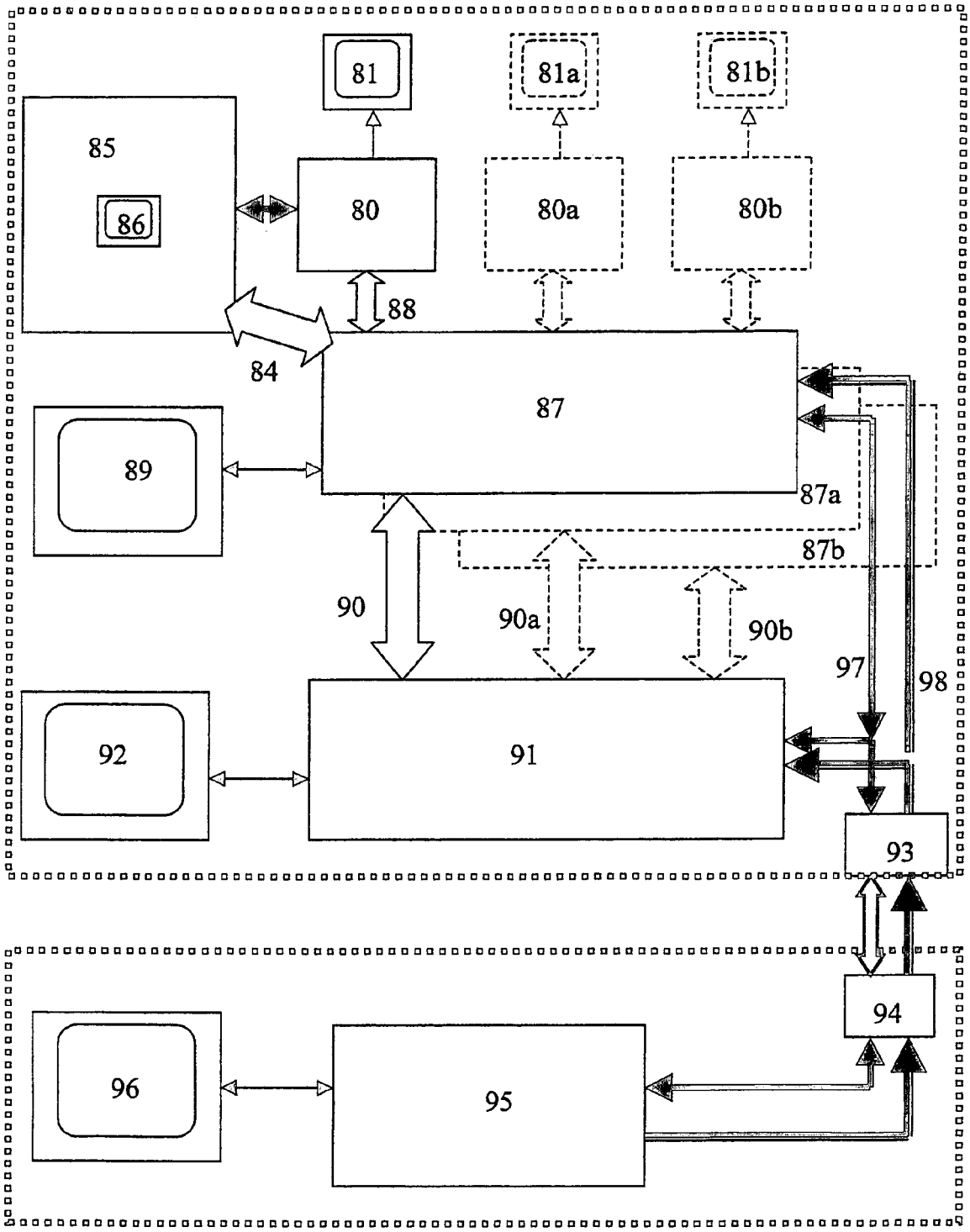
FIG. 6 shows a schematic presentation of a local or remote diagnosis system of machine accessories.

FIG. 6 depicts a block flow chart of a maintenance and service system for a rotor spinning machine. In a control unit 80 of a spinning station 1, is availably held the data for the configuration of the spinning station. This data is collected for use from an automatic detection system, as shown in FIG. 5. Thus, at any time, the actual and real configuration of the spinning station, that is to say, what can be called up includes the wear condition, the presence of a coating or surface treatment (for example, as shown in FIGS. 1A–1E), the presence of a component and/or the type of the installed, exchangeable component. These features can be shown, for example, with a display apparatus 81 at the spinning station. With 81*a*, 81*b* and 80*a*, 80*b*, exemplary additional spinning stations along with their control and display units are indicated.

The configuration data and the conditional data can be optically transmitted, as has been made clear in FIG. 5 with section "B", to a robot 85, or more accurately, to the control unit thereof. Therewith, the data may be retrieved for reading to appear on a display unit 86 on the robot 85. Furthermore, the data can be transmitted over a communication bus 88 between the control unit 80 (for example, this being, a section controller for a group of spinning stations 1) and a central control 87 of the rotor spinning machine. Thereby, the configuration data and the conditional data can be called up on a display device 89 of the control unit 87. From the central control 87, the data can also be transmitted over a communication bus 84 to the robot 85.

From the control unit 87 of the spinning machine, the data can be sent over a communication bus 90 to a plant control unit 91, at which point that likewise can be retrieved at a display unit 92. Further control units 87*a* and 87*b* for the spinning machine and communication busses 90*a*, 90*b* are indicated in dotted lines. These busses are likewise connected with the plant control unit 91.

The control unit of the spinning machine 87 or the plant control unit 91 are connectable over communication lines 97, 98 with a data transmission unit 93. The data issuing from the data transmission unit 93 is received by an external data transmission unit 94 and sent to a service unit 95. At that location, the data may be called up by means of a display unit 96.

Besides the configuration data and the conditional data, the communication channels 84, 88, 90, 93, 94, 97, 98 also transmit the operational parameters of the spinning station, the robot and the spinning machine (such data being, for instance, rotor speed of rotation, spool information, thread removal speed, and input speed of the fiber band). Further, the measured thread quality (thread quality, which, for instance, will be detected by a thread cleaner, this including quality control, thickness, count of faults, etc.) is respectively sent to the supervisory monitoring and control units 85, 87, 91, 95.

Once in possession of the available configuration and/or condition data of the operational and quality parameters, it is possible to compute optimized operational parameters in one of the control units 85, 87, 91, 95, which can be used for spinning at a spin station 80.

Additionally, these parameters can be send back over the communication channels 84, 88, 90, 97, 98, 93, 94 back to the spinning station control 80. In an exemplary manner, the optimizing parameters are sent from the service unit 95 to the external data transmission unit 94. It is also possible, that the data may be sent from the service unit 95 to the data transmission unit 93 and either input into the plant control equipment or resent directly to the control unit 87 on the spinning machine. Centrally, it is possible thus, to become aware of the degree of wear of the exchangeable components and to exhibit the same. The control work and the maintenance activities are simplified, if the spinning station number accompanies the configuration data or the conditional data, so that an assignment and localization becomes possible. Furthermore, the point in time of the detection is confirmed, so that, for example, an accessory and/or wear pattern chronology can be comprised.

With the above, a remote diagnosis system can be realized, wherein, because of the available data, an external evaluation can be undertaken in order that a determination of basic fault causes can be detected in the operational center. Upon the occurrence of disturbances at the spinning station on the above account, it is not necessary in every case that a maintenance operator must be sent immediately to examine the localized system configuration and carry out the results of his analysis.

The present invention is especially applicable where security-relevant components are involved. This group of components could include the spin-rotor, disintegration roll, and support disk. Also, it is possible to include herein the spools, thread removal nozzle or the traverse rods. The recognition of original parts is moreover advantageous for the judgments regarding guarantee cases.

It will be appreciated by those skilled in the art that various modifications and variations can be made in the present invention without departing from the scope of the invention. It is intended that the present invention include such modifications and variations as come within the scope of the appended claims and their equivalents.

The invention claimed is:

1. An exchangeable component of a textile machine, said component comprising at least one of a surface coating and surface treatment which includes color elements embedded therein, said color elements producing an emitted light having a wavelength characteristic when radiated by an inciting light having a selected wavelength, said wavelength characteristic of said emitted light being indicative of a characteristic of said component.

2. A component as in claim 1, wherein said wavelength characteristic of said emitted light is a specific wavelength.

3. A component as in claim 1, wherein said wavelength characteristic of said emitted light is a spectral range of wavelengths.

4. A component as in claim 1, wherein said selected wavelength characteristic of said inciting light is a specific wavelength.

5. A component as in claim 1, wherein said selected wavelength characteristic of said inciting light is a spectral range of wavelengths.

6. A component as in claim 1, wherein said selected wavelength characteristic of said inciting light lies in an ultraviolet spectral range and said wavelength characteristic of said emitted light lies in at least one of a visible spectral range and an infrared spectral range.

7. A component as in claim 1, wherein both of said selected wavelength characteristic of said inciting light and said wavelength characteristic of said emitted light lie in an infrared spectral range.

8. A component as in claim 1, wherein said at least one of said surface coating and said surface treatment has multiple functions.

9. A component as in claim 8, wherein said at least one of said surface coating and said surface treatment is at least one of a protective coating and a friction-reducing coating.

10. A component as in claim 9, wherein said surface coating is a matrix having embedded particles of at least one of a hard material and a friction-reducing material.

11. A component as in claim 10, wherein at least one of said matrix, said hard material particles, and said friction-reducing material particles include color elements.

12. A component as in claim 10, wherein said color elements are embedded particles in said matrix.

13. A component as in claim 10, wherein said matrix includes at least one of nickel and nickel and phosphorous.

14. A component as in claim 10, wherein said hard material particles are at least one of diamond particles and ceramic particles.

15. A component as in claim 14, wherein said ceramic particles are at least one of yttrium-aluminum-garnet, $Al_2O_3$, SiC, and $Si_3N_4$.

16. A component as in claim 15, wherein $Al_2O_3$ ceramic particles are dosed with Cr.

17. A component as in claim 14, wherein ceramic particles are dosed with rare elements.

18. A component as in claim 1, wherein said color elements are at least one of active fluorescent and luminescent coloring materials.

19. A component as in claim 18, wherein said color elements are porous semiconductor particles.

20. A component as in claim 19, wherein said porous semiconductor particles are at least one of porous silicon or porous SiC.

21. A component as in claim 1, wherein said color elements are color-active disturbance points.

22. A component as in claim 1, wherein said component is a spin rotor of an open-end spinning machine.

23. A component as in claim 22, wherein a rotor bowl of said spin rotor is treated with said at least one of said surface coating and said surface treatment.

24. A component as in claim 23, wherein an inner wall of said rotor bowl is coated with said at least one of said surface coating and said surface treatment that serves as a wear resistant layer.

25. A component as in claim 1, wherein said color elements are imprinted on said component.

26. A component as in claim 1, wherein said color elements are invisible to the human eye without special aid.

27. A detection apparatus that identifies color elements included in a surface treatment or a surface coating on an exchangeable component of a textile machine, said detection apparatus comprising:

an illumination device for radiating an inciting light having a selected wavelength characteristic onto a surface area of said exchangeable component having the color elements thereon, thereby illuminating said area;

a light detection apparatus connected in communication with said illumination device, said light detection apparatus sensing a wavelength characteristic of an emitted light, which is emitted from said illuminated area of said exchangeable component; and said wavelength characteristic of said emitted light being indicative of a characteristic of said exchangeable component.

28. A detection apparatus as in claim 27, wherein said selected wavelength characteristic of said inciting light lies in an ultraviolet spectral range and said wavelength characteristic of said emitted light lies in at least one of a visible spectral range and an infrared spectral range.

29. A detection apparatus as in claim 27, wherein both of said selected wavelength characteristic of said inciting light and said wavelength characteristic of said emitted light lie in an infrared spectral range.

30. A detection apparatus as in claim 27, wherein said illumination device includes at least one of a light diode and a laser diode.

31. A detection apparatus as in claim 27, wherein said illumination device includes a fiber light conductor.

32. A detection apparatus as in claim 27, wherein said light detection apparatus includes a photodiode.

33. A detection apparatus as in claim 27, wherein said light detection apparatus includes at least one of a color filter or a bandpass filter.

34. A detection apparatus as in claim 27, wherein said illumination device and said light detection apparatus are carried within an open-end spinning machine having a plurality of workstations.

35. A component as in claim 34, wherein said exchangeable component is a spin rotor.

36. A component as in claim 35, wherein a rotor bowl of said spin rotor is treated with said at least one of said surface coating and said surface treatment.

37. A component as in claim 36, wherein an inner wall of said rotor bowl is coated with said at least one of said surface coating and said surface treatment that serves as a wear resistant layer.

38. A detection apparatus as in claim 36, wherein at least a portion of at least one of said light detection apparatus and said illumination device is disposed on an extendable unit of a service unit of said open-end spinning machine and is extendable from said service unit proximal to said spin rotor disposed within one of said plurality of workstations of said open-end spinning machine.

39. A detection apparatus as in claim 38, wherein a spin rotor cleaning device is also provided on said extendable unit for cleaning of the spin rotor of the workstation.

40. A detection apparatus as in claim 27, wherein said light detection apparatus quantifies measured results of said wavelength characteristic of said emitted light.

41. A detection apparatus as in claim 40, further comprising a data memory apparatus connected in communication with said light detection apparatus, said data memory apparatus receiving and storing said measured results from said light detection apparatus and assigning said results to said exchangeable component from which said measured results are taken.

42. A detection apparatus as in claim 41, further comprising a display device operably connected to said data memory apparatus, said display device providing an interface to retrieve and display said measured results.

43. A detection apparatus as in claim 42, wherein said display device is assigned to a central control of an open-end spinning machine having a plurality of workstations whereby information can be retrieved by said display device for each said workstation.

44. A detection apparatus as in claim 43, wherein at least one of each of said plurality of workstations and a service unit of said open-end spinning machine receive direction based on said measured results from a control unit operably connected to said at least one of said plurality of workstations and said service unit.

45. A detection apparatus as in claim 44, wherein said control unit is said central control.

46. A component as in claim 27, wherein said wavelength characteristic of said emitted light is a specific wavelength.

47. A component as in claim 27, wherein said wavelength characteristic of said emitted light is a spectral range of wavelengths.

48. A component as in claim 27, wherein said wavelength characteristic of said emitted light is a specific wavelength.

49. A component as in claim 27, wherein said wavelength characteristic of said emitted light is a spectral range of wavelengths.

* * * * *